US007562629B2

(12) United States Patent
Lohr et al.

(10) Patent No.: US 7,562,629 B2
(45) Date of Patent: Jul. 21, 2009

(54) MODULAR TRACK SECTION FOR URBAN TRANSPORT VEHICLE IN PARTICULAR SELF-STEERING ON TYRES

(75) Inventors: Robert Lohr, Hangenbieten (FR); René Donnard, Westhoffen (FR)

(73) Assignee: Lohr Industrie, Hangenbieten (FR)

( * ) Notice: Subject to any disclaimer, the term of this patent is extended or adjusted under 35 U.S.C. 154(b) by 363 days.

(21) Appl. No.: 10/576,441

(22) PCT Filed: Oct. 13, 2004

(86) PCT No.: PCT/FR2004/002604

§ 371 (c)(1),
(2), (4) Date: Jun. 1, 2006

(87) PCT Pub. No.: WO2005/042844

PCT Pub. Date: May 12, 2005

(65) Prior Publication Data

US 2007/0079724 A1 Apr. 12, 2007

(30) Foreign Application Priority Data

Oct. 20, 2003 (FR) ..... 03 12260

(51) Int. Cl.

| | |
|---|---|
| ***A63H 19/04*** | (2006.01) |
| ***B61C 7/00*** | (2006.01) |
| *B61C 11/00* | (2006.01) |
| *B61B 12/02* | (2006.01) |
| *B61F 9/00* | (2006.01) |
| *B61K 5/00* | (2006.01) |

(52) U.S. Cl. ..... 105/72; 104/242; 104/243; 104/244; 104/245; 105/72.2

(58) Field of Classification Search ..... 104/242–245; 105/72, 72.2; 180/401; 238/24, 26
See application file for complete search history.

(56) References Cited

U.S. PATENT DOCUMENTS

| | | | | | |
|---|---|---|---|---|---|
| 916,295 | A | * | 3/1909 | Gemmer | 238/26 |
| 1,103,761 | A | * | 7/1914 | Gover | 238/26 |
| 1,731,301 | A | * | 10/1929 | Emmons | 238/8 |
| 2,589,193 | A | * | 3/1952 | Mayne | 244/134 B |
| 4,036,148 | A | * | 7/1977 | Jones et al. | 104/166 |
| 4,090,452 | A | | 5/1978 | Segar | |
| 4,421,300 | A | * | 12/1983 | Lundman | 254/88 |

(Continued)

FOREIGN PATENT DOCUMENTS

| | | | |
|---|---|---|---|
| FR | 2708245 | * | 2/1995 |

(Continued)

*Primary Examiner*—S. Joseph Morano
*Assistant Examiner*—Daniel V Venne
(74) *Attorney, Agent, or Firm*—Davis & Bujold, P.L.L.C.

(57) ABSTRACT

A track section (1) having a framework (2) with two hollow profiled structure boxes (3) open at the top, with substantially rectangular or trapezoid cross-section, maintained parallel and connected by cross members (16) which support a rail (17) for guiding the vehicle. The profiled structure boxes are closed by linear plates acting as running track (8) for the wheels of the vehicle. The inner space (7) provides passage for electrical cables powering the vehicle and/or signaling. The factory prefabricated track sections are ready to be laid on an existing road surface or in a trench with simply compacted base.

23 Claims, 7 Drawing Sheets

U.S. PATENT DOCUMENTS

| | | | | |
|---|---|---|---|---|
| 4,968,178 | A * | 11/1990 | Koster et al. | 404/49 |
| 4,969,400 | A | 11/1990 | Burg et al. | |
| 5,067,867 | A * | 11/1991 | Ruder et al. | 414/391 |
| 5,224,672 | A * | 7/1993 | Testart | 246/415 R |
| 2004/0182946 | A1 * | 9/2004 | Reichel et al. | 238/5 |

FOREIGN PATENT DOCUMENTS

| | | |
|---|---|---|
| FR | 2834268 | 7/2003 |
| GB | 676774 | 8/1952 |

* cited by examiner

MODULAR TRACK SECTION FOR URBAN TRANSPORT VEHICLE IN PARTICULAR SELF-STEERING ON TYRES

This application claims priority from PCT Application No. PCT/FR2004/002604 filed Oct. 13, 2004, which claims priority from French Application Serial No. 0312260 filed on Oct. 20, 2003.

FIELD OF THE INVENTION

The present invention concerns a modular travel lane section for fixed guideway urban transportation vehicles rolling on tires, and a travel lane formed of a succession of a number of travel lane sections.

BACKGROUND OF THE INVENTION

In order to unblock the centers of cities, choked by the traffic of too many automobiles, present urban policy tends to develop mass transportation. The large municipalities thus equip themselves with more and more vehicles of the tramway, trolleybus or subway type.

Among these, the fixed guideway tramways on tires are particularly advantageous for small to medium-sized cities. In fact, they can share the roadway with regular vehicles, requiring little infrastructure work, and can move about on relatively narrow streets. In addition, they have a much greater capacity then that of buses, they are rapid, and are not subjected to the hazards of city traffic.

They must, however, roll on specially designed paths, consisting of rolling tracks, a guide rail, for example centered, and the installation of electrical energy feed, signals and other items. Thus, their installation in an urban milieu, in any event, requires a certain amount of work.

In order to carry out this work, it is usually necessary to close off one or more streets for an extended period of time, the time to dig an adequate trench, divert the existing conduits and pipes, prepare the ground, pour the foundations, carry out surveys for each of the component elements of the lane, install and connect the different components, make the connections, fill in and lay out the areas adjacent to the components of the lane, resurface the roadway damaged by the work, lay out the crossings and the signals, etc. . . .

All this work obviously generates traffic, parking, supply and business access problems as well as noise, dust, etc., which result in significant inconvenience to the inhabitants, the business people, as well as for all the users wishing to use the routes blocked by the work.

It is therefore in the interest of everyone that the installation of the travel lane takes as little time as possible in order to reduce the inconvenience which it causes.

SUMMARY OF THE INVENTION

The objective of the invention is thus to provide a travel lane with an installation that is simplified and which requires work that takes much less time.

To resolve this technical problem, the travel lane according to the invention is in the form of prefabricated modular sections to be installed on prepared ground and assembled on site.

Because of this fact, after the terrain is prepared, all that has to be done on site is to connect the sections to one another; create the branches as required, and to carry out the backfill, finishing and layout work. Many of the steps are carried out in the plant and no longer in the urban environment, which considerably reduces the time for field site work and the inconvenience it causes.

In addition, the lane section, according to the invention, can be installed with its counterparts in a light overlay directly on an existing roadbed, or, for a travel lane that is at the same level as the roadway, on a terrain that is simply prepared and compacted without the need for foundations, which again significantly diminishes the time required for the field site work.

According to the invention, the modular traffic lane sections for fixed guideway urban transportation vehicles on tires consists of a framework formed of two hollowed, shaped caissons, with a section that is more or less rectangular or trapezoidal, having a base that is more or less flat, and two lateral walls, respectively exterior and interior, the caissons maintained more or less parallel and connected by tie plate lacings which support, preferably in their median part, a guide rail designed to serve as a bearing for the guide rollers of the urban transportation vehicle.

A more or less flat band serving as the rolling track for the vehicle wheels is connected to the upper part of these caissons.

Advantageously, the interior space of at least one of these caissons is used for the passage of electrical cables, notably to supply the vehicle and/or auxiliary cables for signals, safety, communications or sources of heat for de-icing.

BRIEF DESCRIPTION OF THE DRAWINGS

Other characteristics and advantages of the intervention will become evident from the reading of the detailed description which follows, a description that makes reference to the attached drawings in which.

DETAILED DESCRIPTION OF THE INVENTION

Figure 1:
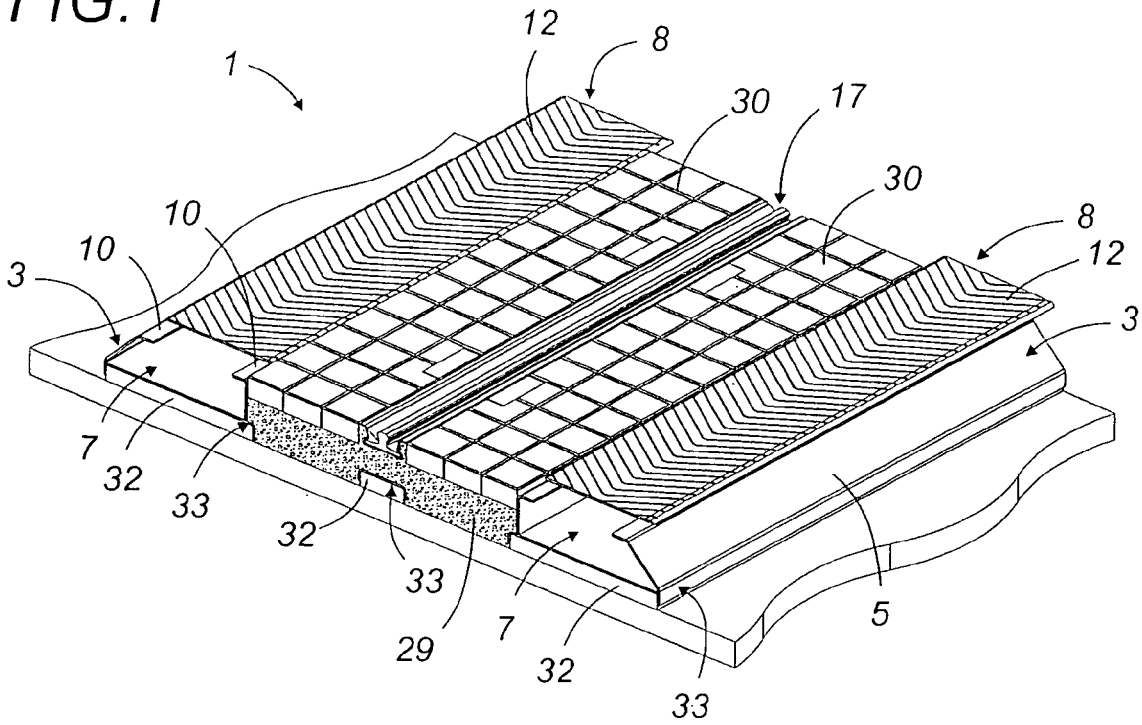
FIG. 1 is a perspective overview of a first variation of a section of lane according to the invention installed by overlaying on an existing roadway.
Figure 2:
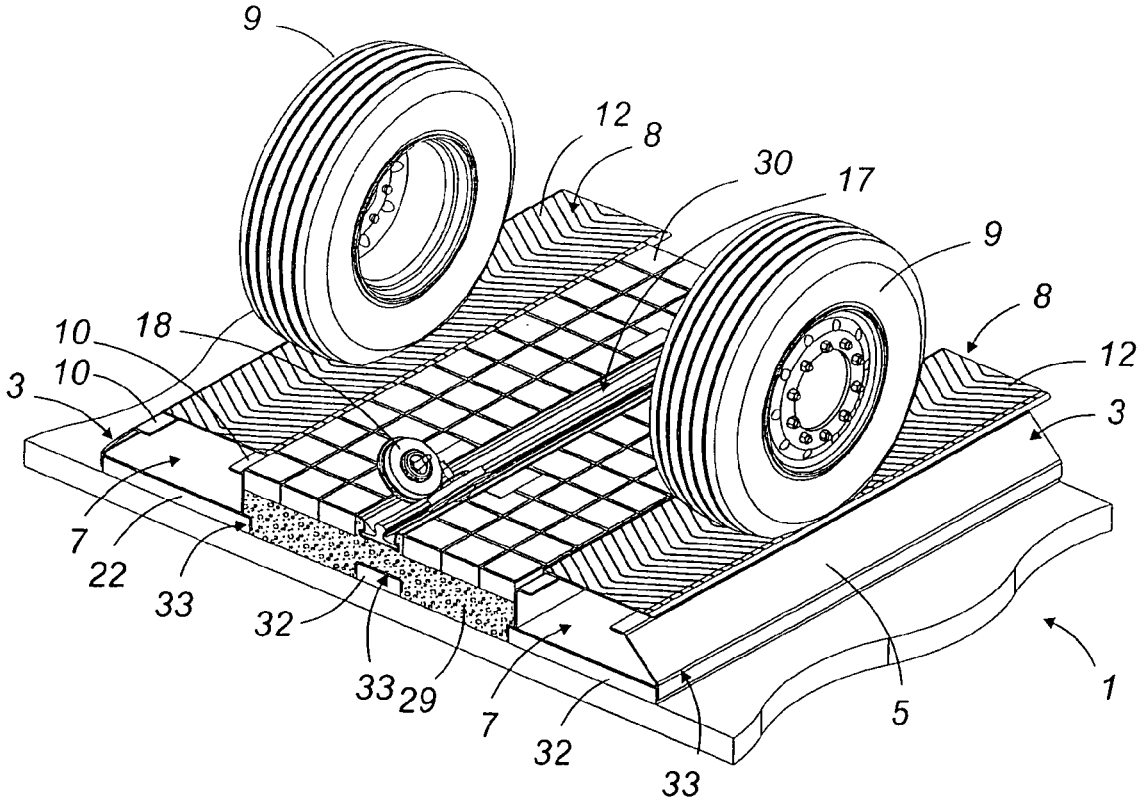
FIG. 2 is a perspective view of the first variation of a section of lane similar to FIG. 1, in which the guide rollers and two wheels of the urban transportation vehicle have been represented.
Figure 3:
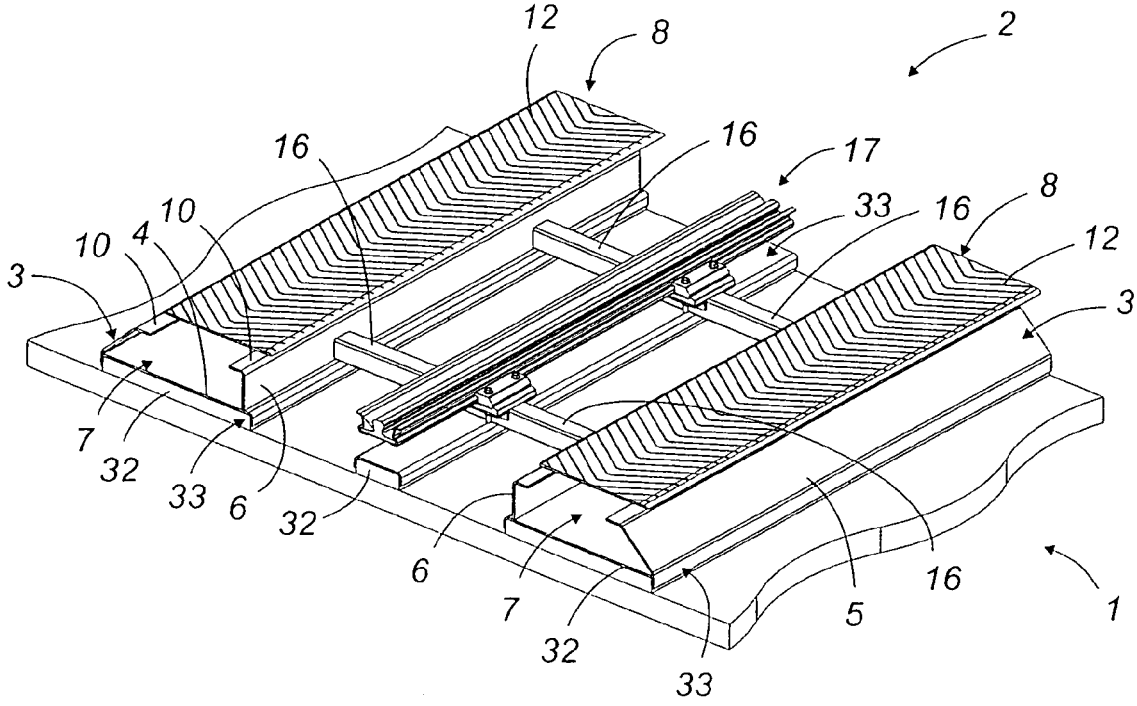
FIG. 3 is a perspective view of the framework of a lane section according to the first variation of the invention.

Several methods of implementation of lane section 1 will now be described in a detailed manner by making reference to FIGS. 1 to 14. However, it must be clearly understood that these are only preferential variations of the invention, given by way of example, and not with the aim of limiting the scope which is defined by the appended claims. The various elements represented in the Figs. have the same numeric references.

Each modular section 1 of the travel lane of an auto guided tramway on tires consists of a framework 2 made up of two tubular shaped caissons 3. These caissons 3 have a base, which is more or less flat 4, and two lateral walls, exterior 5 and the interior 6 respectively, thus delimiting an interior hollow space 7. They preferably have a section in the form that is more or less rectangular or trapezoidal, open on the upside.

These shaped caissons 3 are closed at the upper part by a band 8 that is more or less flat, which serves as the right or left rolling track for the wheels 9 of the tramway on tires. The rolling track 8 consists for example of a succession of linear plates resting on the longitudinal raised edges 10 presenting, for example a return towards the interior of the upper extremities of the lateral walls 5 and 6 of the caissons 3.

In order to ensure a better support for the rolling track, transverse partitioning plates 11 could be provided within the interior of the caissons 3, providing additional support for the rolling track in the upper part.

The band or rolling track 8 forming the rolling path is designed to form a load-bearing road, adapted to urban vehicle transportation traffic. Its form, its structure and the nature of the constituent materials are thus chosen in a manner to best realize this function. They can thus, for example, be metallic or preferably, to limit noise and avoid the phenomenon of heat accumulation in summer, be made of a reinforced synthetic material.

In addition, the rolling track 8 must offer a good adherence to the tires 9 installed on the vehicle, regardless of weather conditions, for example in the event of rain or glaze ice. Advantageously, rolling track 8 can be structured in its upper part, with this upper surface having adhesion ribs 12, for example in chevrons in the represented methods of implementation.

A noise insulating material is preferably inserted between the rolling track 8 and the shaped caisson 3 into which it is inserted. This material limits the level of sound associated with the passage of the vehicle, and can in addition, improve the watertight characteristic of the caisson.

The linear plates constituting the rolling track 8 are joined in a detachable manner to the shaped caissons 3 in a way as to render possible access to their interior space 7.

The interior space 7 of the hollow-shaped caissons 3 forms an interior volume in which to insert various parts, connections and functionalities. It is used, for example, for the routing of the lane's electrical feed cables, for example, for the collection of electricity at ground level, or to feed the catenary poles, and for the routing of auxiliary cables, notably those for signals, safety and communication.

Figure 4:
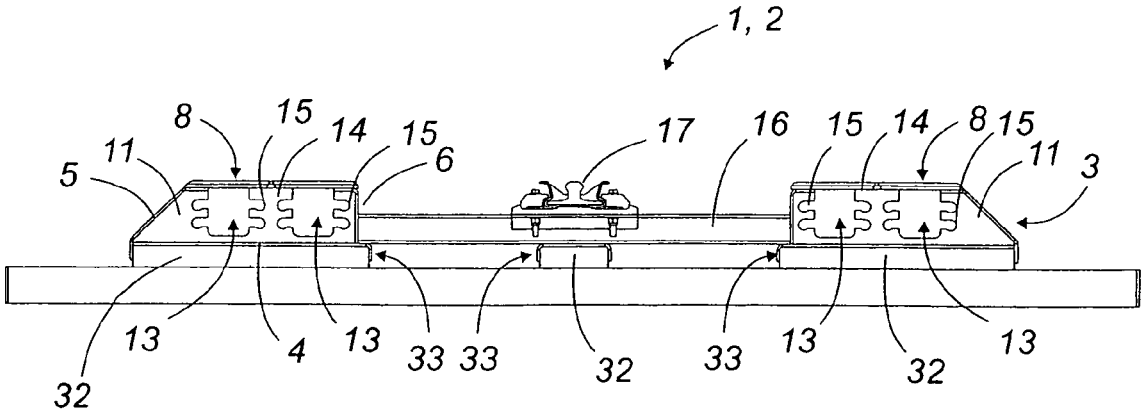
FIG. 4 is a cross-section of view of the framework of the lane section according to the first variation of the invention.
Figure 5:
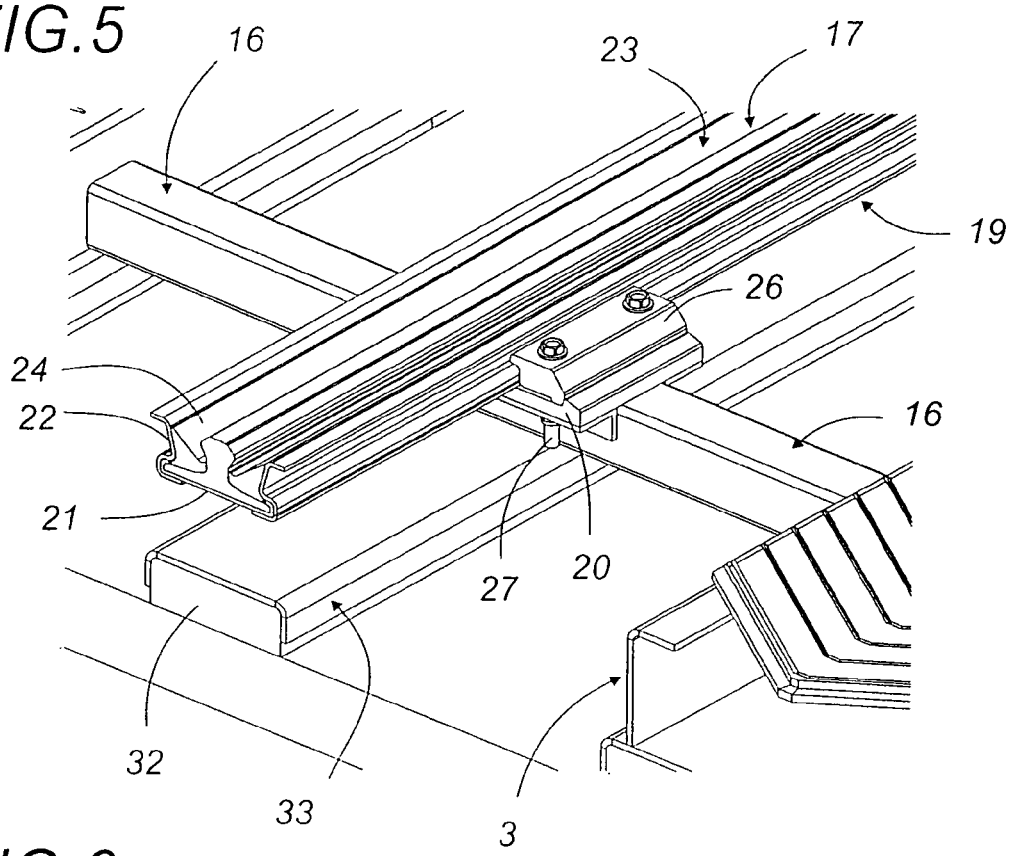
FIG. 5 is an enlargement in perspective illustrating more specifically the section guide rail according to the first variation of the invention.
Figure 6:
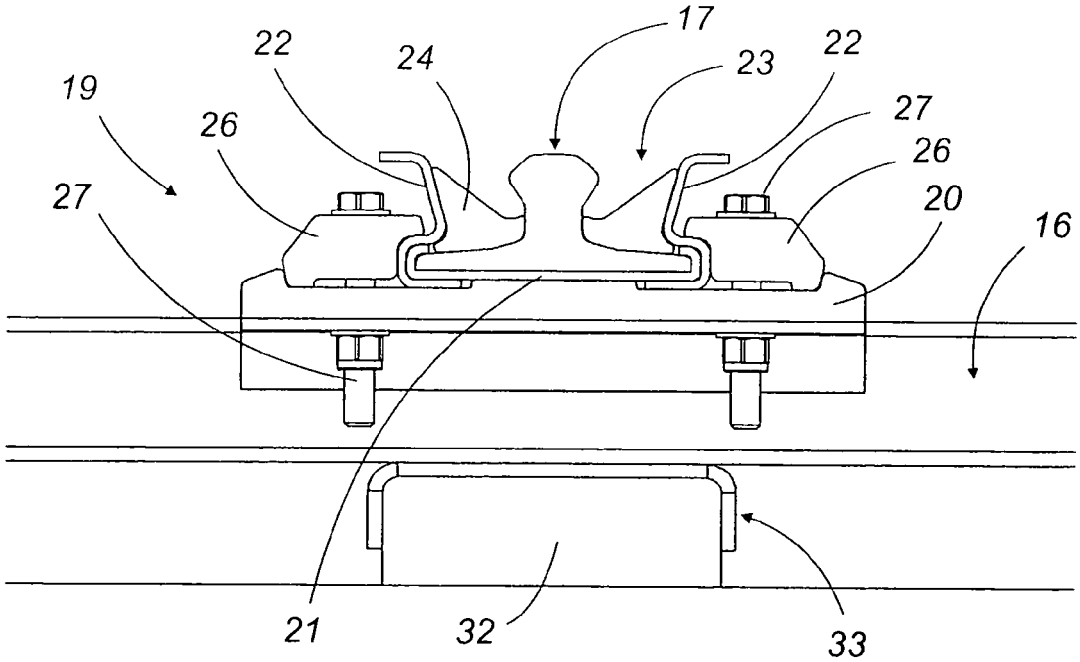
FIG. 6 is a cross-section of the enlargement of FIG. 5 illustrating the guide rail of this section according to the first variation of the invention.
Figure 7:
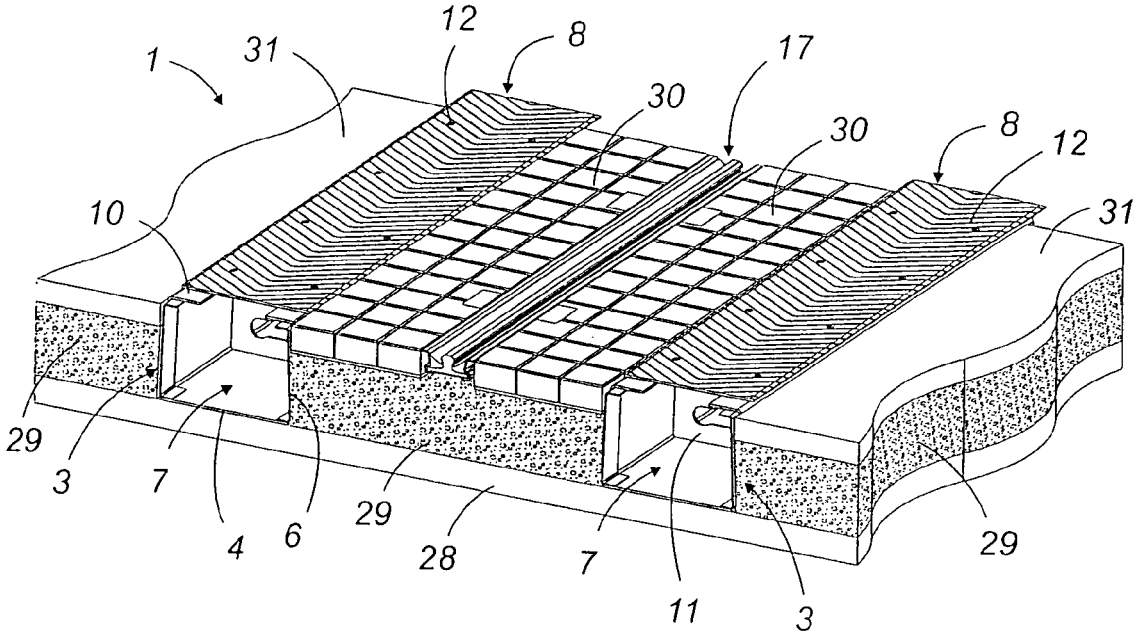
FIG. 7 is an overview in perspective of a second variation of the lane section according to the invention, buried in a trench.
Figure 8:
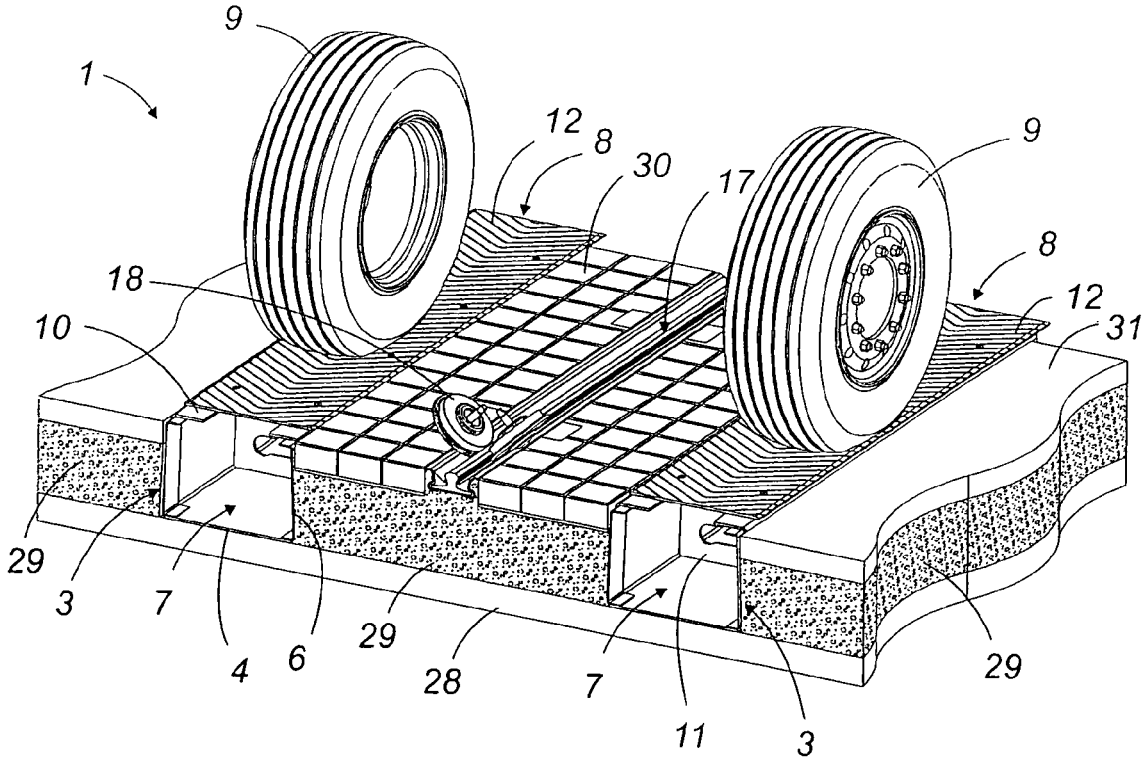
FIG. 8 is a perspective view of the second variation of the lane section, similar to FIG. 7, in which the guide rollers and two wheels of the urban transportation vehicle are represented.
Figure 9:
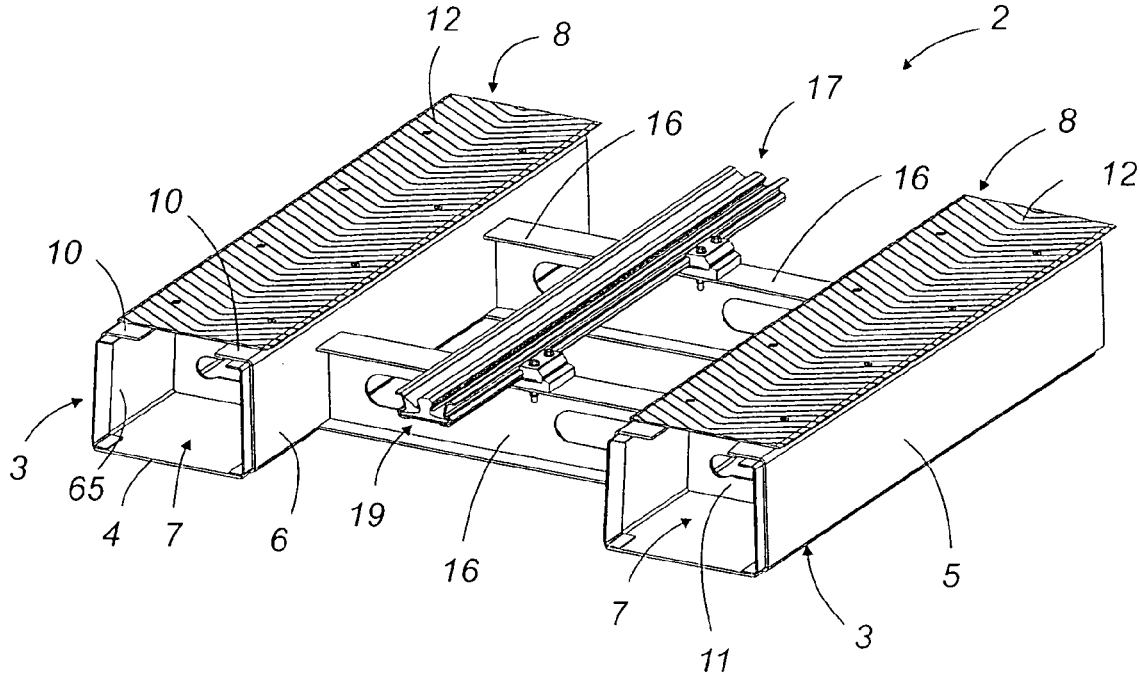
FIG. 9 is a perspective view of the framework of the lane section according to the second variation of the invention.
Figure 10:
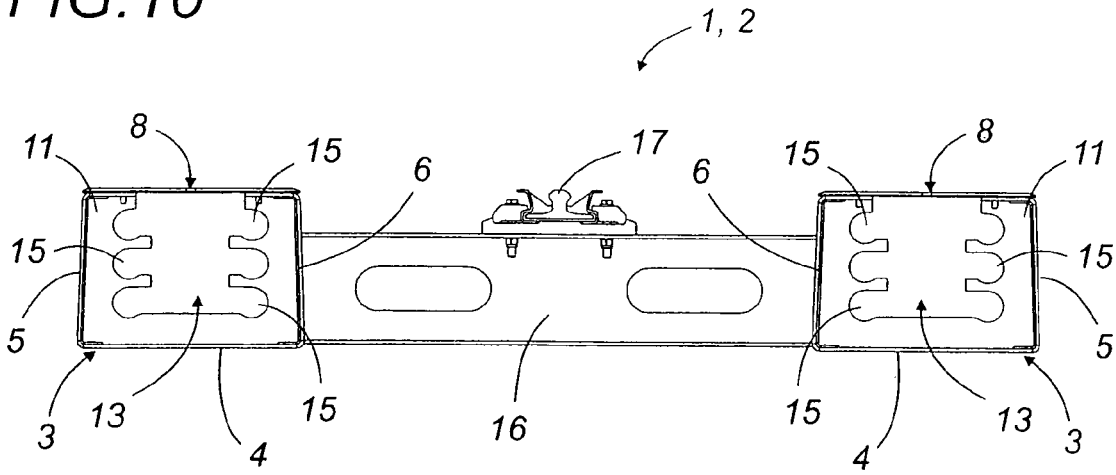
FIG. 10 is a cross-section view of the framework of the lane section according to the second variation of the invention.
Figure 11:
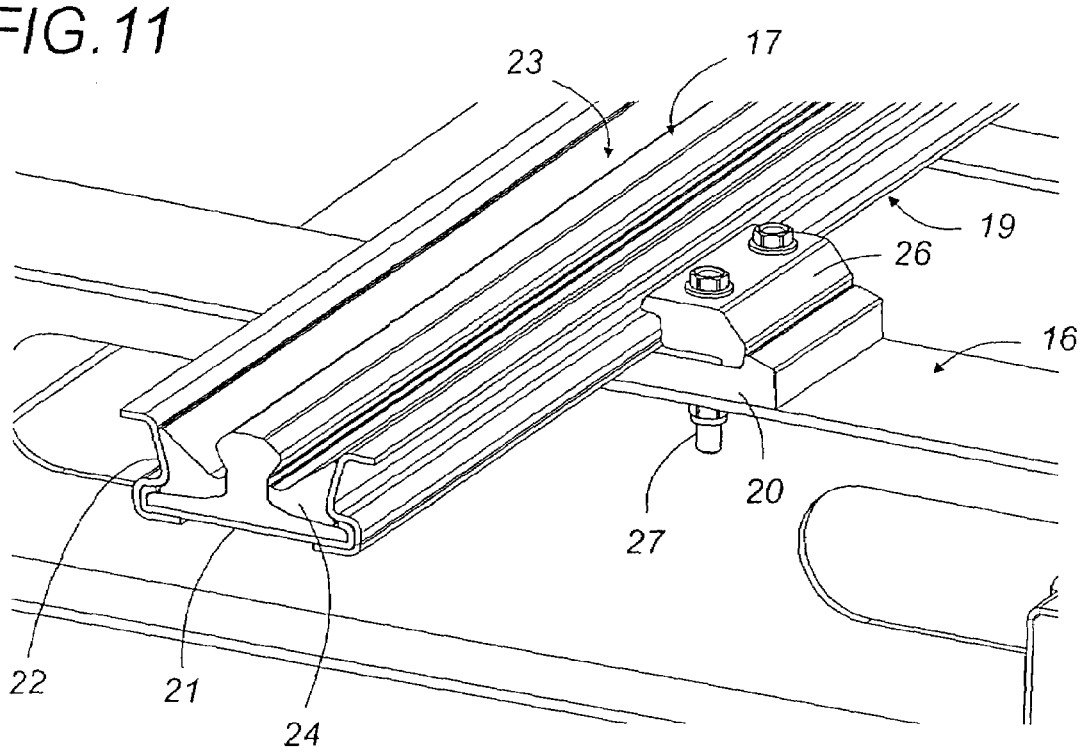
FIG. 11 is an enlargement in perspective illustrating more specifically the guide rail of the second variation of the invention.
Figure 12:
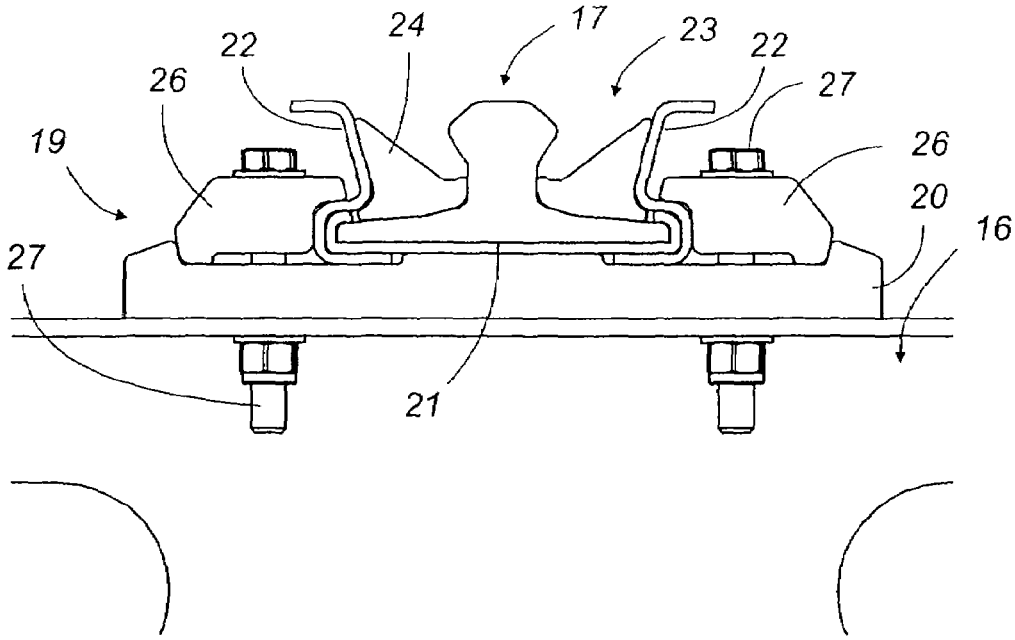
FIG. 12 is a cross-section of view of the enlargement of FIG. 11 illustrating the guide rail of the second variation of the invention.

In this case, the transverse partition plates 11 have cutouts which enable the passage and local support of cables by forming one or more compartments 13 within the interior space 7, for example, a single compartment for the variation represented in FIG. 10, or two compartments separated by an upright 14 for that of FIG. 4.

Housings 15 can be provided in these partitioning plates 11 to receive these cables. Their number, size and placement can vary as a function of the planned applications. These housings 15 are preferably distributed about the perimeter of the cutouts created in the partitioning plate 11, notably at the level of their lateral edges as well as on the walls of the possible uprights 14 separating the compartments.

The volume delimited by the lateral caissons can also serve as a hot air transport duct or for air heated locally, or to shelter the means of heating, or to serve as a container for the heated air conduits in order to avoid icing up, or to carry out de-icing of the rolling track.

The interior space 7 of the caissons 3 can also be filled, for example by use of foam, after installation of the cables, so as to avoid the caissons amplifying the rolling noise of the vehicle by working as a resonance box.

Evacuation orifices, not represented, possibly equipped with tubes, are advantageously provided in the lower part of these shaped caissons in order to evacuate, by means of a drainage network, rainwater likely to penetrate the interior of the caissons.

The shaped caissons 3 are maintained more or less parallel to one another by the tie plate lacings 16 which connect them at intervals, preferably regular, and which are spaced apart by, for example, 1 meter.

These tie plate lacings 16 preferentially support, in their median part, a guide rail 17 designed to serve as a rolling path for the guide rollers 18 for guiding the urban transportation vehicle, for example, by the intermediary of two guide rollers inclined in a V shape from a guide arm of the front of a trolley train on tires, and simultaneously or exclusively from the ground-level electrical energy collecting device.

The guide rail 17 is affixed to each lacing by means of a support mounting 19 resting on a longitudinal support plate 20. This support assembly 19 can be formed of a shaped receptor of bottom section 21, on which is supported the guide tie pad and two counter shaped sidewalls 22, with a section in the shape of an S, for laterally closing the base shape 21 and immobilizing the guide rail.

The base shape 21 can be made from an elastomer, notably of rubber, in order to avoid a direct metal on metal contact and thus absorb vibration and noise.

The upper parts of the counter-shaped sidewalls 22 in each case delimit between themselves and the guide rail, an intermediary space 23, in which it is possible to mold a synthetic material 24, for example, a resin, for filling the lower part of the guide rail 17 to ensure a good cohesion of the assembly and to play the role of a shock absorber. The resin 24 can advantageously be replaced by a filler joint 25, preferably tubular.

The support assembly 19 is attached to each of the lacings 16 by means of guide rail clips or retaining pieces 26 on its support, which on one side rests on the upper part of each longitudinal edge of the support plate 20, and on the other, on the base of the counter shaped sidewalls 22. The assembly formed of the retaining piece 26, the support plate 20, and the lacing 16 being traversed by locking pins 27.

The guidance assembly with collector or collector alone, carried by the vehicle rolling in the lane, could be of the type represented, that is, with two guide rollers 18 inclined in a pointed V with the point directed towards the bottom, with each roller, for example of the socket type rolling on one of the inclined faces of the head of the guide rail 17.

The structure of the lane described above is made of prefabricated sections, connected to one another, for example, like the travel lane sections of a miniature train, or by an appropriate interface. These sections 1 are in the form of rectilinear components of variable length, preferably in the order of ten to twelve meters, and the of curve components.

The curve components can be made from the rectilinear elements which are bent into the appropriate curvature for a given installation. They can also be components of a smaller, variable size which have a shape that is more or less generally trapezoidal, which by successively juxtaposing them, enables the creation of a segmented turn referred to as "facets" which satisfy the imperatives of the offset of the rear wheels.

The framework assembly can be either fixed in a trench or installed by overlaying on already finished existing ground, for example, a roadway.

When the lane according to the invention is installed in a trench, as with the variations represented in FIGS. 7 to 12, it does not have to be installed on foundations or a concrete platform, as is the case with the earlier art. A simple preparation of the base 28 of the trench by compacting is sufficient, with the longitudinal caissons 3 supporting the weight of the vehicle and the effects related to rolling.

The assembly is embedded up to a certain height in a backfill material 29, enabling an adequate immobilization of the framework. Advantageously, the depth of the trench and the height of the caissons are selected so that the rolling tracks 18 and the upper part of the guide rail 17 are effectively made level with the ground.

The free intermediate space contained between the two rolling bands 8 is also filled with an appropriate backfill material 29. The entire system can be completed at the surface by a decorative or technical coating, or by a plant, grass or other parterre. This coating is preferably in the form of plates 30, for example, paving stones, slabs, tiles, or is sown with grass seed.

In addition, the ground laterally bordering the lane according to the invention is surfaced-coated, for example, by a coat of bitumen if the lane is embedded in the roadway, or by a technical or decorative coating 31 of some kind that can be installed locally as a platform.

The travel lane sections according to the invention are designed to be installed in an urban environment. They are not necessarily installed in reserved zones, and must be able to be crossed by regular road vehicles at level by means of installed crossings. In these zones, the surface covering must be selected in an appropriate manner to fulfill this function, and notably to support the weight of possible truck traffic. They could for example be paving stones, concrete slabs or other.

FIGS. 1 to 6 illustrate a variation of the lane section according to the invention designed to be directly installed on a roadway, or pre-existing, more or less regular finished ground.

The travel lane is thus elevated in relation to the ground. So that this overlaying is not too significant, the shaped caissons 3 are preferably shorter then those of the variation designed to be buried.

In addition, the exterior lateral wall 5 of each caisson 3 is preferably inclined so as to improve their bedding and to create a progressive slope toward the ground, thus conferring on the shaped caissons 3 a section shape that is more or less trapezoidal.

The modular sections of the lane according to the invention are immobilized in the ground by means of bands of resin 32 sunk longitudinally in the ground within the longitudinal anchoring forms 33, two of which arm the sub-face of the caissons 3, and a third is connected to the lower face of the tie plate lacings 16 and extend transverse to these latter, under the rail 17.

These anchoring forms 33, preferably made of formed steel, have the shape of an inverted gutter with the section that is more or less an open rectangle facing down. It is anchored in the resin 32 so as to totally immobilize the lane section. Casting the resin on site results in filling of the pre-existing irregularities in the ground.

As in the case of the variation previously described, the intermediary free space between the two rolling bands is filled with an appropriate fill material 29, that is then surfaced-dressed with a decorative or technical coating, preferably in the form of plates 30.

Locations for crossing by the road vehicle lanes can also be established. In these locations, the surface coatings are chosen in the appropriate manner to support the weight of vehicles. Graduated ramps can also be provided at these levels on either side of the lane section to enable road vehicles to reach the level of the lane and to re-descend from it so as to bridge the crossing with ease.

Figure 13:
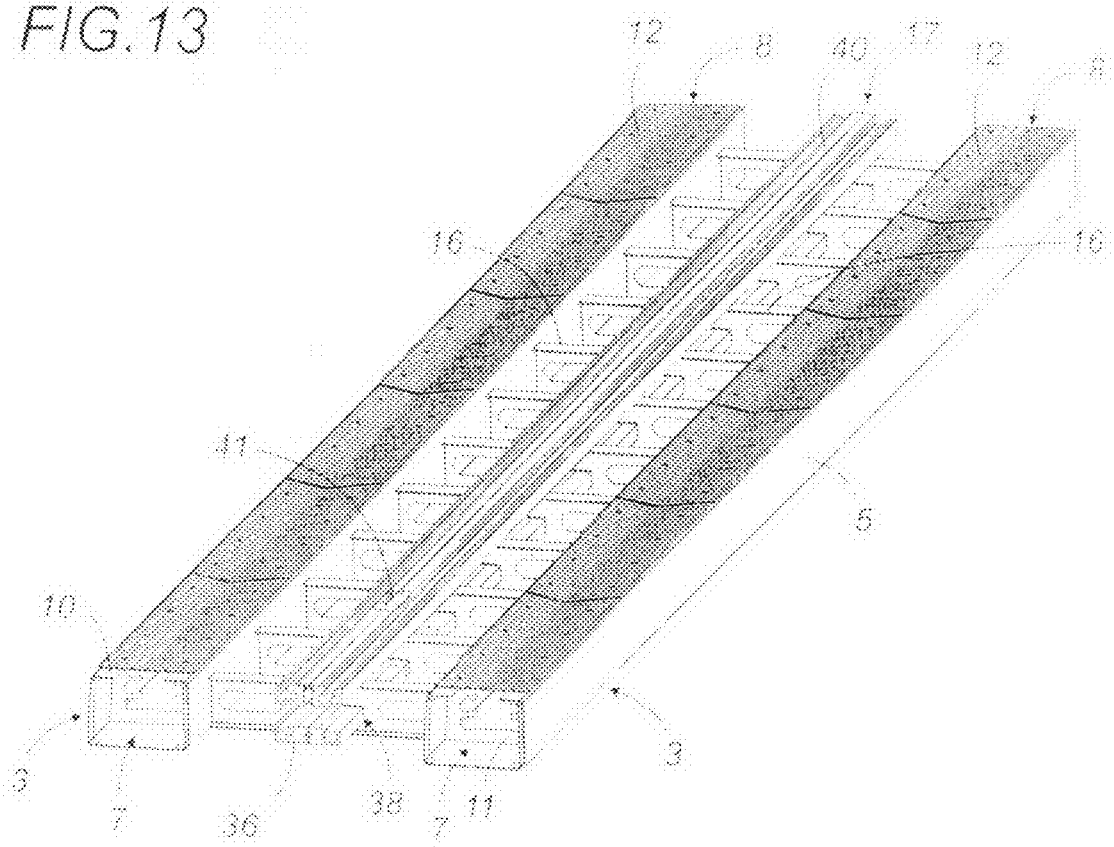
FIG. 13 is a perspective view of the framework of a lane section enabling the collection of electricity at ground level according to a third variation of the invention.
Figure 14:
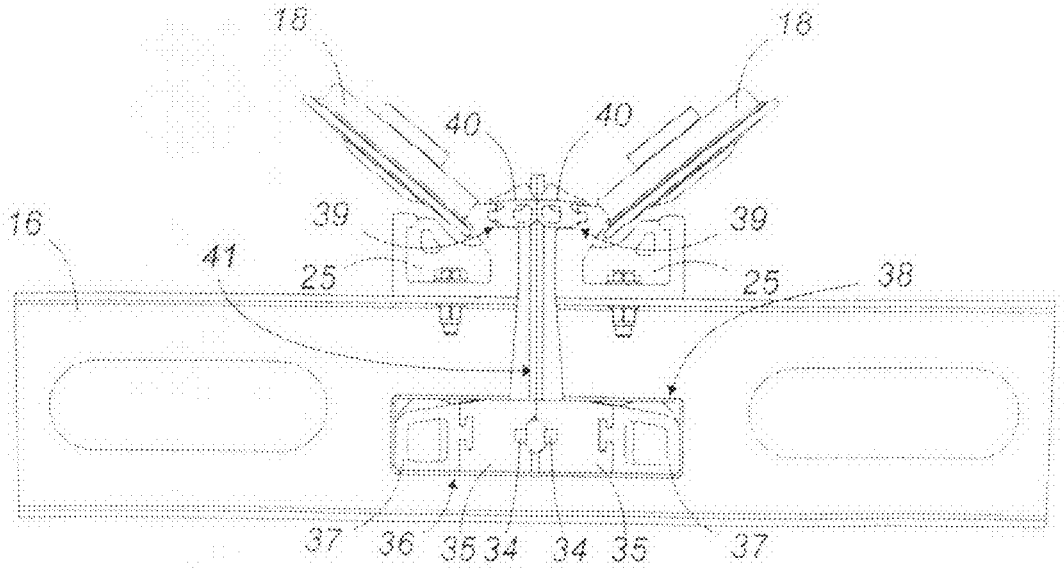
FIG. 14 is a cross-section view of the framework of the lane section according to the third variation of the invention.

A last variation of the invention is represented in FIGS. 13 and 14. This is a lane section equipped with more than one ground level electrical collection device. This device, which is simultaneously protected by the applicant, will thus be only briefly described.

This ground-level electrical energy collecting device consists of a collection shoe 41 (similar to a third rail shoe) attached to the vehicle, which has preferably at its lower extremity, conductive parts that are connected electrically to the vehicle's feed circuit.

In addition, it includes two linear polar parts 34 mounted in two holder shapes 35 located side-by-side, and carried by a carrier shaped support 36 with a more or less flat base and two lateral walls. Each of these holders 35 is provided over its length with elastic recall toward its adjacent counterpart by a linearly compressible mechanism 37 housed between each holder 35 and the corresponding lateral wall of the carrier shaped support 36.

In this variation, each of the tie plate lacings 16 has a transverse housing 38 open to receive the carrier shaped support 36.

In order to let the collection shoe 41 pass, the guide rail 17 is formed out into semi-rails 39 which can advantageously be equipped with a linear insulation protection 40 as a cover which opens locally by the passage of the shoe, for example, by separating it.

The invention is obviously not limited to the preferred implementation methods described above and represented, but also includes all the numerous variations and modifications belonging to the same inventive concept that a person skilled in the art would be capable of imagining without difficulty.

Thus for example, we have described and represented travel lane sections in general by plan and horizontal illustration. One could equally envisage the realization of a lane which, viewed in cross-section, would be inclined like a "circumflex accent" in the manner of many roadways, which would improve the runoff of rainwater on the sides and limit the formation of glaze ice.

The invention claimed is:

1. A plurality of modular lane sections for being located juxtaposed one another to form a travel lane for an urban transportation vehicle in which the vehicle is a fixed guideway vehicle rolling on tires, wherein each of the plurality of modular lane sections comprising a framework (2) formed of two laterally profiled hollow caissons (3) with each caisson (3) having one of a rectangular or trapezoidal cross-section, a base (4) that is at least approximately flat, an exterior wall (5) and an interior wall (6), an approximately flat band track (8) is fixed to an upper part of the exterior wall (5) and an upper part of the interior wall (6) supports the tires of the vehicle, the caissons (3) being substantially parallel to one another and interconnected by tie plate lacings (16), to which a rail (17) for guiding the vehicle is secured, the base (4), the exterior wall (5), the interior wall (6) and the flat band track (8) form the hollow caisson (3) and define a protected interior space (7) and each of the plurality of modular lane sections has only one electricity collecting device at around level.

2. The plurality of modular lane sections according to claim 1, wherein the interior space (7) of at least one of the hollow caissons (3) defines a passage, at least one of electrical cables for an electrical feed for the vehicle and auxiliary cables for one of signals, security and communication pass through the interior space (7).

3. The plurality of modular lane sections according to claim 1, wherein the interior space (7) of at least one of the hollow caissons (3) defines a passage through which air passes heated by heating means.

4. The plurality of modular lane sections according to claim 1, wherein the interior space (7) of at least one of the hollowed caissons (3) defines a housing, which encloses a means to heat one of air within one of the caissons (3) or plates forming the rolling track (8).

5. The plurality of modular lane sections according to claim 1, wherein the track (8) is formed by a succession of linear plates, which are connected, in a removable manner, to the caissons (3) facilitating access to the interior space (7) of the caissons (3).

6. The plurality of modular lane sections according to claim 1, wherein an upper surface of the band track (8) has adhesion ribs (12).

7. The plurality of modular lane sections according to claim 1, wherein a sound insulating material is affixed to the caisson (3) and located between the band track (8) and the caisson (3).

8. The plurality of modular lane sections according to claim 1, wherein at least one of the caissons (3) has at least one transverse partitioning plate (11) within the interior space (7) formed in the caissons (3).

9. The plurality of modular lane sections according to claim 8, wherein the at least one transverse partitioning plate (11) has housing cut-outs (15) which enable a passage and local support of cables.

10. The plurality of modular lane sections according to claim 1, wherein the caissons (3) have water drainage orifices in a lower portion thereof.

11. The plurality of modular lane sections according to claim 1, wherein a support assembly (19) is supported on a longitudinal support plate (20) and affixes the guide rail (17) to the tie plate lacings (16) essentially mid-way between the two caissons (3).

12. The plurality of modular lane sections according to claim 11, wherein the support assembly (19) is affixed to each of the lacings (16) by clip type retaining pieces (26).

13. The plurality of modular lane sections according to claim 1, wherein each of the plurality of modular lane sections is installed as a light overlay directly on one of a roadway and on pre-existing finished ground.

14. The plurality of modular lane sections according to claim 13, wherein the exterior lateral wall (5) of at least one of the caissons (3) is substantially inclined with respect to the base (4) and the flat band track (8) such that one of the base (4) and the flat band track (8) is wider than an other of the base (4) and the flat band track (8).

15. The plurality of modular lane sections according to claim 13, wherein each of the plurality of modular lane sections is immobilized by bands of resin (32) cast longitudinally along one of the roadway and the ground.

16. A plurality of modular lane sections for being located juxtaposed one another to form a travel lane for an urban transportation vehicle in which the vehicle is a fixed guideway vehicle rolling on tires, wherein each of the plurality of modular lane sections comprising a framework (2) formed of two laterally profiled hollow caissons (3) with each caisson (3) having one of a rectangular or trapezoidal cross-section, a base (4) that is at least approximately flat, an exterior wall (5) and an interior wall (6), an approximately flat band track (8) is fixed to an upper part of the exterior wall (5) and an upper part of the interior wall (6) supports the tires of the vehicle, the caissons (3) being substantially parallel to one another and interconnected by tie plate lacings (16), to which a rail (17) for guiding the vehicle is secured, the base (4),the exterior wall (5), the interior wall (6) and the flat band track (8) form the hollow caisson (3) and define a protected interior space (7);

each of the plurality of modular lane sections is installed as a light overlay directly on one of a roadway and on pre-existing finished ground;

each of the plurality of modular lane sections is immobilized by bands of resin (32) cast longitudinally along one of the roadway and the ground; and each of the plurality of modular lane sections includes longitudinal anchoring forms (33), affixed to an inferior face of the caissons (3) and the tie plate lacings (16) under the guide rail (17) and the modular lane section (1) is anchored to the resin (32) via the anchoring forms (33).

17. The plurality of modular lane sections according to claim 1, wherein each of the plurality of modular lane sections is buried in a trench in which a bottom (28) of the trench is compacted.

18. The plurality of modular lane sections according to claim 1, wherein an intermediate free space, between the two band tracks (8), is filled (29) with a fill and a top surface of the fill is covered by one of decorative plates (30) and technical plates (30).

19. A plurality of modular lane sections for being located juxtaposed one another to form a travel lane for an urban transportation vehicle in which the vehicle is a fixed guideway vehicle rolling on tires, wherein each of the plurality of modular lane sections comprising a framework (2) formed of two laterally profiled hollow caissons (3) with each caisson (3) having one of a rectangular or trapezoidal cross-section, a base (4) that is at least approximately flat, an exterior wall (5) and an interior wall (6), an approximately flat band track (8) is fixed to an upper part of the exterior wall (5) and an upper part of the interior wall (6) supports the tires of the vehicle, the caissons (3) being substantially parallel to one another and interconnected by tie plate lacings (16), to which a rail (17) for guiding the vehicle is secured, the base (4), the exterior wall (5), the interior wall (6) and the flat band track (8) form the hollow caisson (3) and define a protected interior space (7); and each of the plurality of modular lane sections has a plurality of ground level electricity collection devices.

20. The plurality of modular lane sections according to claim 1, wherein at least one of the plurality of modular lane sections is approximately rectilinear.

21. The plurality of modular lane sections according to claim 1, wherein at least one of the plurality of modular lane sections is a longitudinally curved element.

22. The plurality of modular lane sections according to claim 1, wherein at least one of the plurality of modular lane sections has an approximately trapezoidal shape which enables turning, either when used alone or in combination with a succession of trapezoidal shaped lane sections.

23. The plurality of modular lane sections according to claim 1, wherein at least one of each of the plurality of modular lane sections is, when viewed in cross section, inclined in a shape of a circumflex accent.

* * * * *